United States Patent [19]

Olivero

[11] 4,062,528

[45] Dec. 13, 1977

[54] DEVICE FOR DIRECT ANNEALING OF METAL WIRE LEAVING AN OPERATING MACHINE

[75] Inventor: Carlo Olivero, Turin, Italy

[73] Assignee: Ditta M. El. F.O., Turin, Italy

[21] Appl. No.: 760,541

[22] Filed: Jan. 19, 1977

[30] Foreign Application Priority Data

Jan. 19, 1976 Italy ..... 67110/76

[51] Int. Cl.[2] ..... C21D 9/56

[52] U.S. Cl. ..... 266/103; 148/153; 266/112

[58] Field of Search ..... 148/153; 72/286; 242/47.07, 47.08, 47.09, 47.11; 266/102, 103, 112

[56] References Cited

U.S. PATENT DOCUMENTS 2,979,321 4/1961 Peterson ..... 266/103 X

FOREIGN PATENT DOCUMENTS 544,661 6/1957 Canada ..... 266/103

*Primary Examiner*—Roy Lake
*Assistant Examiner*—Paul A. Bell
*Attorney, Agent, or Firm*—Browdy and Neimark

[57] ABSTRACT

A device for annealing metal wire leaving an operating machine. At least one drum inside a sealed heating chamber rotates synchronously with the machine supplying the wire and takes up the wire. The drum is heated so that by conduction heating the wire is heated to annealing temperature. The wire is then passed through a reservoir of cooling liquid, then dried when it leaves the chamber. The chamber is filled with an inert fluid to prevent the wire from rusting.

4 Claims, 4 Drawing Figures

DEVICE FOR DIRECT ANNEALING OF METAL WIRE LEAVING AN OPERATING MACHINE

FIELD OF THE INVENTION

The present invention relates to a device for direct annealing of metal wire leaving an operating machine and more particularly to a device whereby the metal wire is heated up to the recrystallization phase and subsequently cooled, all this at the speed at which the wire is processed by the operating machine, whether it be a wire-drawing or an extrusion assembly or any other machine suitable for supplying semi-finished metal wire continuously.

DESCRIPTION OF THE PRIOR ART

Obviously the device can also be used in combination with any other machine processing metal wire to be finished or converted to the annealed condition during processing such as, for example, back-winders, hot or galvanic tin-plating mechanisms, doubling machines, cable-making machines, machines for applying insulating layers of any type, etc. It is known that while they are being worked, particularly in plastic working, metals become work-hardened, namely the crystal structure changes such that the metal has noteworthy hardness and elasticity; in most cases this condition is an obstacle to further working.

Hence, an annealing process is needed to bring the physical characteristics of the metals being worked to the most suitable conditions either for end-use or for subsequent working.

In the specific field of metal wire, many systems are used to anneal the metal wire, but almost all of them are static. More specifically, the metal wire, wound on a reel, is placed in a heating chamber and then cooled. All of this requires a great deal of dead time in processing and demands large assemblies and a consequently high wire-processing cost. With the present state of the art only one dynamic system is used today with machines producing or using metal wire, namely the Joule effect of electrical resistance system.

In devices whereby this system can be used, the wire passes over two or more metal sheaves connected to a source of electrical energy, such that it is traversed by a high current which heats it to the desired temperature. Suitable devices enable the electrical voltage applied to the wire through the sheaves which function as contact elements to be regulated. In theory this wire-annealing system is perfect, but in practice it is very far from perfection and the greater the wire's rate of travel the less perfect the system. It should be possible, by varying the rate of travel and cross section of the wire, to vary the voltage applied to the contact electrodes (in this case sheaves), which voltage must be kept within well-defined limits, failing which the wire will melt or be insufficiently annealed. To this disadvantage, which per se is a problem very difficult to solve, is added that of transmission of the current, always very high, from the surface of the sheave to the wire through a very tiny contact area, for which reason sparking can easily occur. This, to varying degrees of visibility, damages the surface of the wire and erodes the outside of the contact sheaves — a situation which rapidly deteriorates. In addition to the wire being damaged, the sheaves, which are relatively costly, have to be replaced frequently.

SUMMARY OF THE INVENTION

The principal purpose of the present invention is to eliminate these disadvantages with an original solution of extreme simplicity, the devices enabling control and adjustment of the wire temperature also being relatively simple.

Substantially, the invention is composed of one or more metal drums heated by suitable means and made to rotate synchronously with the machine supplying the wire to be annealed. These drums have circumferential grooves around their outsides to receive the wire which can thus encircle the drums one or more times and receives heat therefrom by direct conduction. The diameters of the drums and the number of times the wire is wound around their surfaces are established such as to ensure that the wire is in contact with the drum for a sufficient time for it to reach the annealing temperature. These two parameters are fixed and proportional to the maximum operating speed for which the machine is rated. One variable parameter, however, is the temperature at which the drums are kept.

Temperature regulation can be accomplished by simple and safe devices (thermocouples, resistors, thermistors, etc.), and its value is a function of the wire's cross section and rate of travel. Contrary to the case with the Joule effect annealing system, the metal of which the wire is composed has little significance and its electrical resistance has no significance. According to a preferred embodiment, the heated drums are made of stainless steel and are heat-resistant so that their wear is negligible and service life is long; they can be heated by means of electric resistors provided in the drums themselves, supplied by metal rings and metal-graphite brushes. In this way, contrary to the case with the aforesaid Joule effect system, the supply currents are low and the voltages sufficiently high without the need for special transformers. To prevent the wire from rusting, the chamber in which the drums are located is sealed such that it can contain a neutral environment which can be obtained with any type of inert gas, steam for example, both because of the great ease of producing steam and because, as will be seen hereinbelow, it can be used in the superheated form to transmit heat to the drums and hence to the annealed wires. The device in question is also provided, each time annealing occurs and after the machine has stopped, with a suction unit which expels the air from the annealing chamber, which air is immediately replaced by steam. In this way, the amount of wire oxidized at the beginning of annealing is reduced to negligible proportions.

This suction unit then recirculates the steam after passing it through a heat exchanger which raises it to the preset temperature.

BRIEF DESCRIPTION OF THE DRAWINGS

The characteristics of the invention will now be illustrated in greater detail in the description hereinbelow of some preferred but nonexclusive embodiments, referring to the drawings wherein.

DETAILED DESCRIPTION OF THE PREFERRED EMBODIMENTS

Figure 1:
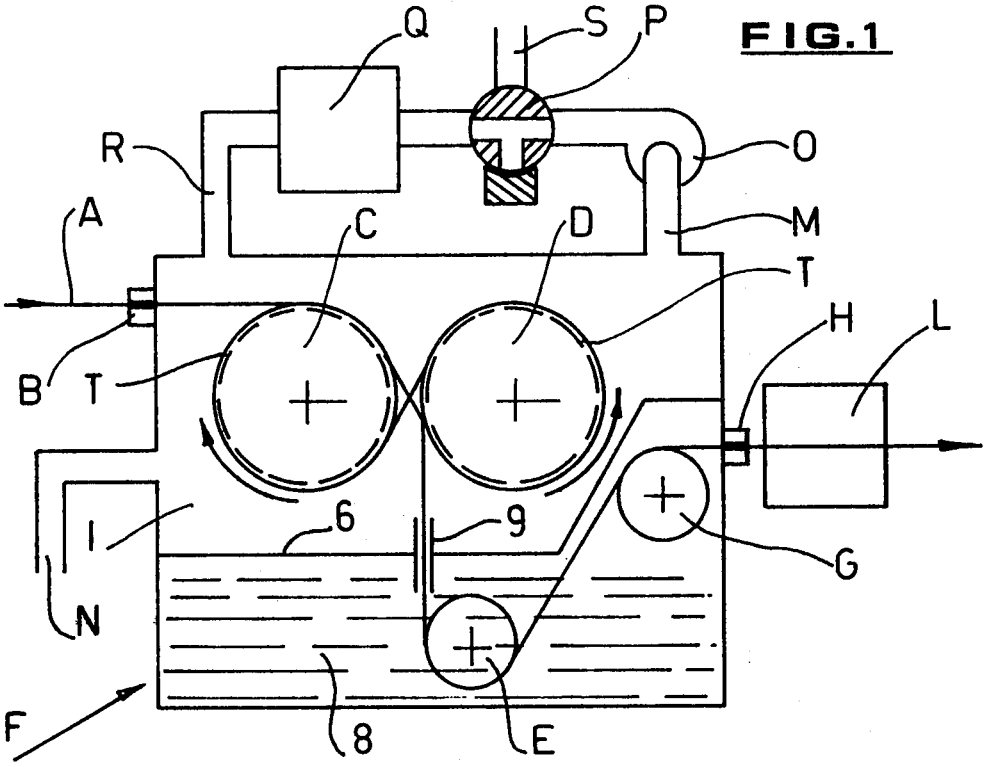
FIG. 1 shows the invention in a schematic side view.

With reference to FIG. 1, the invention comprises a heating chamber I which is steam-tight and heat-insulated. Heating chamber I is provided with a hermetically sealed passage B whereby the metal wire to be processed enters.

By means of a pipe N, heating chamber I communicates with a superheated steam generator, not shown in the drawings, and is connected by means of a pipe M to an aspirator-compressor O connected to a heat exchanger Q, in its turn connected to heating chamber I via pipe R. A valve P is provided in the pipe connecting aspirator-compressor O to heat exchanger Q, which valve can be controlled manually or automatically and leads to an exhaust pipe S for evacuation of the air in heating chamber I at the beginning of the operating cycle, as will be seen more clearly hereinbelow.

Two drums C and D are provided and suitably supported in heating chamber I, said drums having parallel axes and cylindrical surfaces which are heated by suitable means, as for example electrical resistors provided inside the drums and supplied by metal rings and metal-graphite brushes (not shown in the drawings). On their outside cylindrical surfaces, these drums have a series of circumferential grooves T able to receive the wire, denoted A, which wire can encircle the drums from which it received heat by direct conduction alternately and several times.

The inside of heating chamber I is divided by a diaphragm 6 which, in the lower part, delimits a cooling chamber F provided with a reservoir 8 containing cooling liquid (for example water); this diaphragm is provided with a suitable aperture 9 for passage of metal wire A from heating chamber I to the cooling chamber. Inside the cooling chamber are two return sheaves E and G the first of which enables the wire to pass into the cooling liquid and the second is for the wire to leave the cooling chamber through a hermetically sealed passage H. After this passage H is provided a device L for drying the wire before it passes to the machine using it or to the wire coiler.

Now that the component parts of the device have been described, a description will now be given of its operation.

Wire A enters chamber I through passage B and is wound several times and alternately around heating drums C and D where it is heated by direct conduction until it reaches the annealing temperature. As it leaves drums C and D, wire A passes over sheave E and then through the cooling liquid in reservoir 8, where it cools down. It then passes over sheave G and exists through sealed passage H. As already stated, before passing to the machine using it or to the wire coiler, wire A is dried at B by felt wipers and compressed air nozzles (not shown in the drawings). In the starting phase, while steam is being supplied to heating chamber I through pipe N, valve P is in a position such that it causes aspirator-compressor O to communicate with pipe S in order to exhaust through S the fluid (steam + air) drawn from chamber I by aspirator O. This is necessary to prevent the metal wire from rusting during processing due to the presence of air in the annealing chamber. After a suitable time has elapsed, when the fluid in chamber I contains no more air, valve P is switched so that it places aspirator-compressor O in communication with heat exchanger Q to cause the fluid in chamber I to return through the heat exchanger and pipe R after undergoing suitable heating. Under these circumstances, if one considers the annealing of the metal wire arriving at heating chamber I to be a continuous cycle, the quantity of wire oxidized is reduced to negligible values corresponding to the quantity of wire used to prime the device. During the entire operating cycle the cooling liquid is kept at the necessary temperature by an appropriate heat exchanger (not shown in the drawings).

Figure 2:
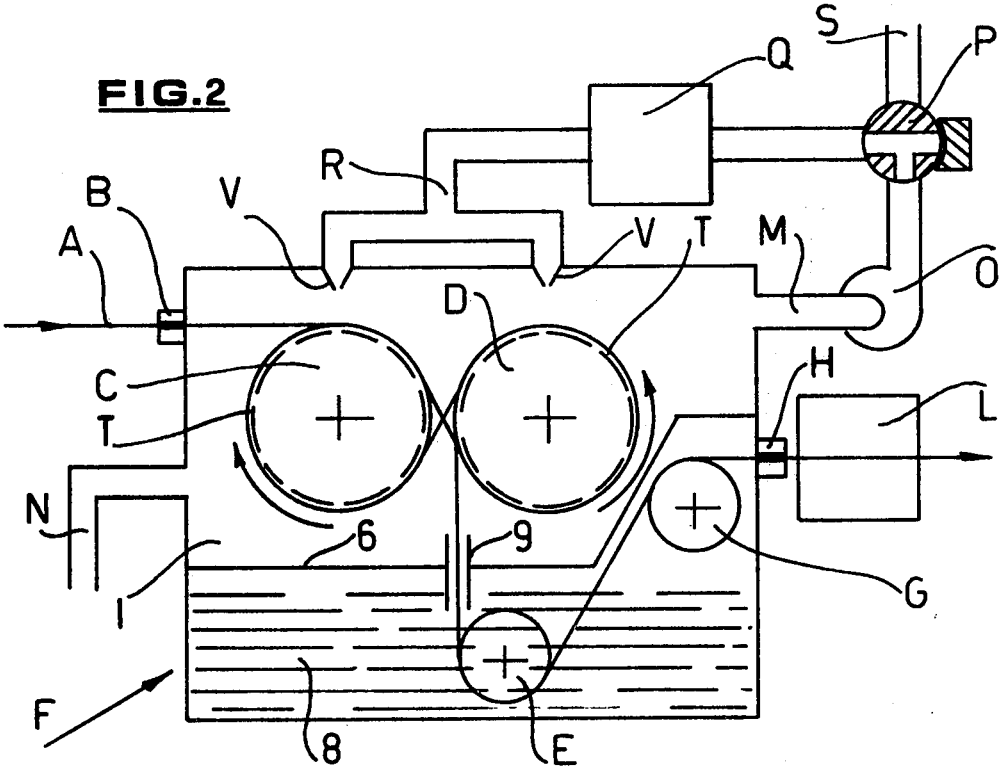
FIG. 2 shows the invention schematically according to a structural variant wherein the drums are heated not only by means inserted therein but by a circuit able to blow superheated steam onto the drums.

According to the structural variant in FIG. 2 for heating drums C and D, in addition to the electrical resistors provided above, the external cylindrical surfaces thereof are blasted with a jet of superheated steam from two nozzles V disposed in correspondence with the drums. The steam is the same steam introduced into heating chamber I, as seen above, leaving heat exchanger Q, and pipe R is shaped such that its outlets, namely nozzles V, are in correspondence with drums C and D. The temperature of heat exchanger Q and the electrical resistors provided inside drums C and D is controlled separately to optimize drum heating.

Figure 3:
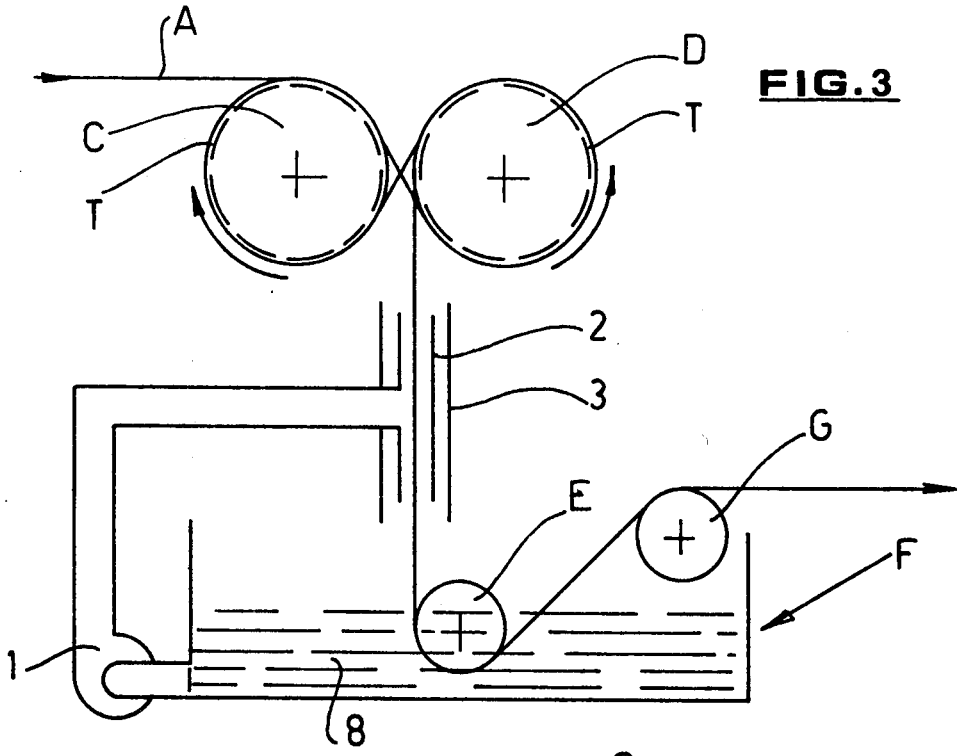
FIG. 3 shows schematically a structural variant of the circuit for cooling the metal wire as it leaves the heated drums.
Figure 4:
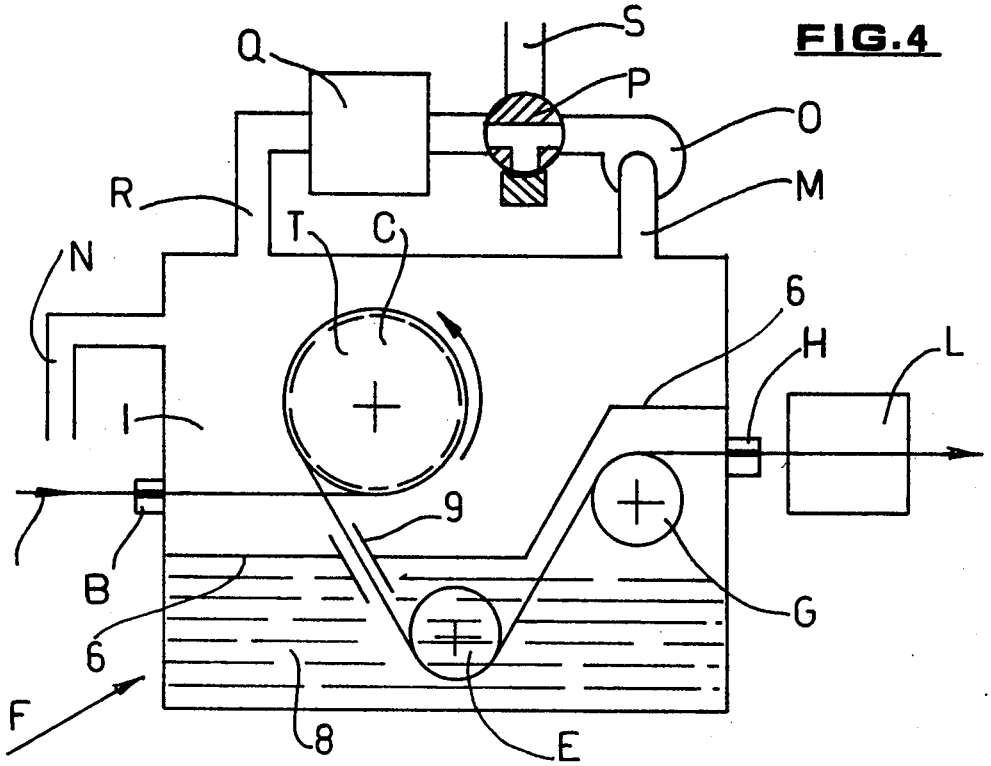
FIG. 4 shows schematically another structural variant of the invention wherein a single heated drum is provided on which to coil the metal wire.

As stated in the list of figures, FIG. 3 shows a structural variant of the cooling circuit for the metal wire leaving the heated drums. According to this embodiment heating chamber F is provided with an outlet pipe S connected to a pump I able to draw the cooling liquid from the cooling chamber and discharge it to a cooling tube 2 which can be traversed by the metal wire leaving heated drums C and D and provided inside a tube 3 which collects the excess liquid spilling from the top of tube 2 and discharges it into liquid reservoir 8. In this way the metal wire undergoes two successive cooling phases: the first inside tube 2 and the second when it is inside the cooling chamber, passing around return sheave E and passes through the cooling liquid, with optimal final cooling, especially when the device is operating at high speed. According to the structural variant of FIG. 4, the invention, entirely similar to that illustrated in FIG. 1, is provided with a single heated drum, denoted C, while all the other devices are exactly the same as those shown in FIG. 1.

A similar device can be employed when the operating speed is slow and it is possible to heat the wire sufficiently with a limited heating surface. In this case, wire A, entering annealing chamber I, coils around about 340° of heated drum C and then passes over sheaves E and G, leaving the cooling chamber through sealed passage H. Drums C and D and sheaves E and G are driven such that they are synchronous with the drives of the machines operating in combination with the invention, and may either be driven by means independent of said operating machines or be controlled thereby.

I claim:

1. Device for annealing metal wire leaving an operating machine, comprising at least one drum with parallel axes supported inside a sealed heating chamber with a heated inert-fluid production source, said chamber being provided with a hermetically sealed inlet for supplying metal wire to said heating chamber, said drums being designed to heat the wire by direct conduction and subjected to the action of heating devices acting internally or externally to heat at least their cylindrical surfaces up to a temperature sufficient to achieve annealing of the metal wire coiled around them, and being provided externally with one or more circumferential grooves able to receive the wire coiled around them; a circuit for closed-loop circulation and heating of the inert fluid in the heating chamber and for evacuation of the air contained therein at the beginning of the operating cycle, comprising an aspirator-compressor connected directly at its inlet with the heating chamber and at its outlet with a heat exchanger, the outlet of which is connected in its turn with the heating chamber, as well as a valve disposed in the pipe connecting the aspirator-compressor to the heat exchanger, able, in a first position, to provide said connection and, in a second position, to place the aspirator-compressor in communication with the outside atmosphere; a cooling chamber, connected to the heating chamber, containing a cooling fluid, provided with a hermetically sealed outlet for outward passage of the metal wire; and means for drying the metal wire disposed downstream of said cooling chamber outlet for the wire.

2. Device for direct annealing of metal wire leaving an operating machine, according to claim 1, further including one or more discharge nozzles provided in the closed loop inert-fluid circulation circuit in the heating chamber downstream of the heat exchanger, communicating with the heating chamber and disposed in correspondence with the drums on which the metal wire is coiled to directly blow the heated fluid entering the heating chamber onto the outer lateral surface of the drums.

3. Device for direct annealing of metal wire leaving an operating machine according to claim 1, wherein the cooling chamber contains a liquid cooling fluid and is provided with at least one pair of return sheaves able to pass the metal wire from one to the other, at least one of which is disposed below the level of the cooling liquid.

4. Device for direct annealing of metal wire leaving an operating machine according to claim 3, further including a first cooling pipe disposed such that it can be traversed by the wire entering the cooling chamber and connected to a pump which draws cooling liquid and discharges it inside said pipe, said first pipe being disposed inside a second pipe able to collect the cooling liquid leaving the upper part thereof and return it to the cooling chamber.

* * * * *